US006569260B2

(12) United States Patent
Rhodes

(10) Patent No.: US 6,569,260 B2
(45) Date of Patent: May 27, 2003

(54) NON-SOLVENT VERY LOW VOC FORMULATION FOR REMOVAL OF INK FROM PRINTING PRESSES AND THE LIKE, AND METHODS OF USING THE SAME

(75) Inventor: Keith A. Rhodes, Stone Mountain, GA (US)

(73) Assignee: Microblend, LLC, Morrow, GA (US)

( * ) Notice: Subject to any disclaimer, the term of this patent is extended or adjusted under 35 U.S.C. 154(b) by 0 days.

(21) Appl. No.: 10/173,943

(22) Filed: Jun. 19, 2002

(65) Prior Publication Data

US 2002/0155963 A1 Oct. 24, 2002

Related U.S. Application Data

(62) Division of application No. 09/634,256, filed on Aug. 7, 2000, now abandoned.

(51) Int. Cl.[7] ..... B08B 3/04; C11D 1/72; C11D 3/37; C11D 3/26; C11D 3/10

(52) U.S. Cl. ..... 134/38; 134/42; 510/170; 510/171; 510/172; 510/173; 510/174; 510/421; 510/422; 510/433; 510/434; 510/435; 510/504; 510/506

(58) Field of Search ..... 510/170, 171, 510/172, 173, 174, 421, 422, 433, 434, 435, 504, 506; 134/38, 42

(56) References Cited

U.S. PATENT DOCUMENTS

| | | | | | |
|---|---|---|---|---|---|
| 5,009,716 | A | | 4/1991 | Gerson | 134/40 |
| 5,746,814 | A | * | 5/1998 | Malhotra et al. | 106/18 |
| 5,854,196 | A | * | 12/1998 | Baillely et al. | 510/427 |
| 5,902,782 | A | * | 5/1999 | Hall et al. | 510/349 |
| 5,904,735 | A | * | 5/1999 | Gutierrez et al. | 8/137 |
| 5,914,302 | A | * | 6/1999 | Murch et al. | 510/293 |
| 5,925,681 | A | * | 7/1999 | Cristanti et al. | 514/643 |
| 5,977,055 | A | * | 11/1999 | Trinh et al. | 510/515 |
| 5,980,580 | A | * | 11/1999 | Yamaguchi et al. | 8/137 |
| 6,034,045 | A | * | 3/2000 | Carr et al. | 510/361 |
| 6,153,577 | A | * | 11/2000 | Cripe et al. | 510/356 |
| 6,265,365 | B1 | * | 7/2001 | Herget et al. | 510/170 |
| 6,326,341 | B1 | * | 12/2001 | Chatterjee et al. | 510/221 |

* cited by examiner

*Primary Examiner*—Gregory DelCotto
(74) *Attorney, Agent, or Firm*—Jacobson Holman PLLC

(57) ABSTRACT

A water-based formulation for the removal of ink comprising a detergent builder including sodium carbonate, neutralized polyacrylic acid, and an acrylic acid/maleic anhydride copolymer; a chelating agent including tetrasodium ethylenediaminetetraacetate and ethylenediaminetetraacetic acid; and a detergent/emulsifier including C9-11 Pareth 8, C6-12 Pareth 6, and PEG Cocomonium Chloride.

2 Claims, No Drawings

NON-SOLVENT VERY LOW VOC FORMULATION FOR REMOVAL OF INK FROM PRINTING PRESSES AND THE LIKE, AND METHODS OF USING THE SAME

This is a divisional of application Ser. No. 09/634,256 filed Aug. 7, 2000, now abandoned.

BACKGROUND OF THE INVENTION

1. Field of the Invention

The present invention is related to the printing industry and, more particularly, to a water-based formulation for the removal of ink from printing presses and equipment.

2. Description of the Related Art

For decades, solvent-based products have been used to clean printing presses and equipment used in the printing industry. When using solvent-based products, ink dissolves quickly even if it has dried on the equipment, and the surface of the equipment dries quickly, ensuring a minimum of down time.

However, solvent-based products also present distinct disadvantages. Solvent mixtures are highly volatile and release potentially harmful Volatile Organic Compounds (VOC's) into the atmosphere. Solvents have been implicated in the health and safety of workers, often being irritating or corrosive to human tissues and having been identified as having target organ effects. Furthermore, many solvents are either flammable or combustible, increasing the risk to those working with such substances.

Solvents also generate adverse environmental effects, polluting the air and contributing to ozone creation, smog and poor air quality, and also polluting waterways if they are discharged directly to streams, rivers or lakes. In some areas it is illegal to discharge solvents into the air or water.

In addition to not being readily biodegradable in the environment, solvents are not compatible with wastewater treatment facilities and contribute to the creation of hazardous waste disposal problems. As a result, disposal of waste solvent is extremely expensive, requiring proper packaging, labeling and the maintenance of associated documentation.

In view of these disadvantages, serious efforts have been undertaken to reduce the solvent content of many products including that of printing inks. Many printing ink formulas that once contained hydrocarbon-based and water-insoluble solvents have been reformulated using a variety of water-based solvents. The emphasis of many regulatory agencies is to significantly reduce any material that is considered a VOC. This trend away from solvents has been an improvement, but some ink still contains VOC's.

Companies manufacturing the products used in the cleaning of printing equipment, while recognizing the health and environmental encumbrances associated with high VOC-content solvents, have not been eager to reformulate in order to eliminate solvent materials for several reasons. First, the performance of water-based products has not rivaled that of solvent-based products in the speed of ink removal. Second, the cost of water-based products has been considerably higher than that of solvents. Third, water-based products require significantly more cleaning and drying time and more manual labor in removing ink than solvent-based products and this translates into a significantly higher cost of clean-up to the user. Finally, water-based cleaners frequently contain corrosive components like sodium hydroxide which can cause severe and permanent chemical burns. If the formulated product has a high pH, i.e., over 12, additional health and safety equipment is generally required for use, adding to the expense of using a product of this type.

In addition to these problems, current water-based products do not truly solve the VOC problem. While traditional solvents have a VOC content approaching 100%, water-based products still have VOC levels in the range of 30–50%. In addition, many water-based ink cleaners currently in use depend on the incorporation of solvents that fall under the designation of "VOC exempt" materials. These solvents would meet the definition of a VOC were it not for specific legislation exempting such solvents from being categorized as volatile. An example of such a VOC exempt material is acetone. Other exempt solvent materials are of natural origin, such as components pressed from orange peels. Many companies consider these materials to be different from the more traditional solvents like mineral spirits or kerosene.

Under the test applicable to industries today, any material that will evaporate, within specific limits, is considered to be a VOC and, notwithstanding specific exempting legislation, many regulations make no exception for "exempt" materials, including those of natural origin. As a result, there is a definite need for a water-based formulation that is both effective for the removal of ink and which truly contains a low level of VOC's.

SUMMARY OF THE INVENTION

In view of the foregoing, one object of the present invention is a water-based cleaning product having very low VOC levels, i.e., on the order of 2% or less, and methods of using the same.

Another object of the invention is a water-based cleaning product and its use where the composition has an ink-removal effectiveness that is comparable to that of solvent-based products.

A further object of the invention is an ink-removal product and its use that does not pose health or safety risks to workers.

A still further object of the invention is the provision and use of a water-based cleaning formulation in which the ingredients do not contribute to air or water pollution, and are not considered hazardous materials.

Yet another object of the invention is a water-based cleaning formulation that is biodegradable and compatible with wastewater treatment facilities.

In accordance with this and other objects, the present invention is directed to a water-based formulation having a VOC content of 2% or less, a pH of not more than 11.5, and an ink-removal rate comparable to that of solvent-based products. The formulation consists of a mixture of a water-soluble detergent builder, a chelating agent, and a detergent and emulsifier. The detergent builder increases the effectiveness of the detergents and is no more than 13% by weight. The chelating agent binds metals that may be present in the ink and does not exceed 9% by weight. The detergent/emulsifier system wets and emulsifies the ink and does not exceed 16% by weight. The balance of the formulation is water.

These together with other objects and advantages which will become subsequently apparent reside in the details of the formulation as more fully hereinafter described and claimed.

DETAILED DESCRIPTION OF THE PREFERRED EMBODIMENTS

According to one embodiment of the present invention, there is provided a water-based formulation consisting of a mixture of a water-soluble detergent builder, a chelating agent, and a detergent/emulsifier. This mixture, when applied to an ink-laden surface, is sufficiently aggressive that the ink may be removed from the surface without mechanical agitation.

The detergent builder increases the effectiveness of the detergents and is a mixture of sodium carbonate at a level of 0–5% by weight, neutralized polyacrylic acid at a level of 2–7% by weight, and acrylic acid/maleic anhydride copolymer at a level of 2–7% by weight. The level of each ingredient may be varied within the ranges, allowing the resulting composition to work over a wider range of ink formulations. The total builder is no more than 13% by weight.

The chelating agent binds metals that may be present in the ink and is selected from the group consisting of tetrasodium ethylenediaminetetraacetate, ethylenediaminetetraacetic acid, and mixtures thereof. In a preferred embodiment, the chelating agent is a mixture of tetrasodium ethylenediaminetetraacetate at a level of 1–8% by weight and ethylenediaminetetraacetic acid at a level of 1–8% by weight; the total level of chelating agent should not exceed 9%. The level of each ingredient may be varied within the ranges, allowing the resulting composition to work over a wider range of ink formulations.

Other materials may be substituted for those identified in connection with the detergent builder and the chelating agent, as would be known by persons of skill in the art. However, many such substitutions, while still allowing the ink to be removed, may leave a residue that interferes with subsequent inking of the equipment and therefore do not represent the preferred embodiment of the present invention.

The detergent/emulsifier system, which wets and emulsifies the ink, is composed of C9–11 Pareth 8 at 1–10% by weight, C6–12 Pareth 6 at 0.5–5% by weight, and PEG Cocomonium Chloride at 1–10% by weight. The total concentration of the detergent/emulsifier should not exceed 16% by weight. The balance of the formulation is water.

As would be known by persons of skill in the art, "Pareth" is a name accepted in the industry for a particular chemical composition in the alkoxylated alcohol class, with "Pareth 6" and "Pareth 8" being a polyethylene glycol ether of a mixture differing according to the amount of ethylene oxide added to each material as well as the carbon chain length used in the hydrophobic portion of the molecule. For example, according to the International Cosmetic Ingredient Dictionary and Handbook Vol. 1 (John A. Wenninger et al. eds., $8^{th}$ ed. 2000), C9–11 Pareth-8 is a polyethylene glycol ether of a mixture of synthetic C9–11 fatty alcohols with an average of 8 moles of ethylene oxide.

Other materials may be substituted for the materials used in the detergent/emulsifier system provided such substitutes have chain lengths similar to those found in the components of coconut oil, generally in the range of C12 to C18 even carbon chains. In addition, these materials must be quaternized.

The inventive formulation may be used full strength for heavy ink soil or may be diluted with up to 20 parts of water for effective cleaning of light ink soils. During testing of the inventive formulation, inks demonstrated an acceptable rate of removal at dilutions of the formulation with water of between 1:4 and 1:9. At such recommended levels of dilution for general use, the formulation exhibits a recorded level of VOC of 0, enabling the present invention to effect a very significant reduction in the quantity of VOC introduced into the environment when compared with prior art formulations.

The water-based formulation of the present invention removes ink from surfaces at a rate that is comparable to that of solvent-based products. For some inks, only a slightly increased amount of manual agitation is required. Manual agitation may also be employed to speed the removal of ink. The drying time of this formulation is longer than for solvent products, but this has not caused a significant problem for users.

The product in accordance with the present invention does not have a flash point up to its boiling point of 212 degrees F., and can be used in the temperature range of ambient to 180 degrees F without decomposition or a reduction in effectiveness. .

Use of the new water-based formulation of the present invention requires no special safety equipment and is considered a non-hazardous waste, not meeting the criteria of a hazardous material as defined by the Department of Transportation or the Occupational Safety & Health Administration. None of the formulation ingredients are known to be air or water pollutants and all of the ingredients are both biodegradable and compatible with wastewater treatment facilities. Furthermore, the product does not contain any water-soluble solvents.

EXAMPLE

This is an example of a formula for an ink removing composition in accordance with the present invention.

Water, 76%

Sodium Carbonate, 1%

Neutralized polyacrylic acid, 2%

Acrylic acid/maleic anhydride copolymer, 5%

Tetrasodium ethylenediaminetetraacetate, 4%

Pareth 8, 5%

Pareth 6, 2%

PEG Cocomonium Chloride, 5%

The present invention is also directed to a method of removing ink from printing presses using a non-solvent, very low VOC formulation such as that which has been described. According to the method, a formulation consisting essentially of a detergent builder, a chelating agent, and a detergent/emulsifier is applied to an inked surface of printing equipment. In a preferred embodiment, the detergent builder is a mixture of sodium carbonate, neutralized polyacrylic acid, and an acrylic acid/maleic anhydride copolymer; the chelating agent is selected from the group consisting of tetrasodium ethylenediaminetetraacetate, ethylenediaminetetraacetic acid, and mixtures thereof; and the detergent/emulsifier includes C9–11 Pareth 8, C6–12 Pareth 6, and PEG Cocomonium Chloride.

The formulation may be applied in any convenient way. During testing, the solution was found to work effectively whether sprayed on, flooded onto parts of the printing presses and other equipment, mopped onto surfaces to be cleaned, or used as a bath in which equipment pieces are soaked.

However it is applied, the formulation is allowed to penetrate and combine with the ink and is thereafter removed from the surface. The formulation may be removed by wiping, mopping, draining, etc. Mechanical agitation of the surfaces being cleaned is not required. However, prior to removal, or as part of the removal process, the surface may be subjected to mechanical agitation to speed the process of combining the ink with the formulation.

The formulation may be reapplied as needed until the ink, or other substance to be removed, has been essentially fully cleared from the surface of the printing equipment. Water may be applied to the surface as a final rinsing step if desired.

Although the present invention has been described by reference to specific embodiments thereof, it is to be understood that suitable modifications may be made without departing from the scope of the present invention as described above and defined in the following claims.

What is claimed is:

1. A method for removing ink from a surface of printing equipment, comprising the steps of:

(a) applying a formulation consisting essentially of a mixture of sodium carbonate at a level of 0–5% by weight, neutralized polyacrylic acid at a level of 2–7% by weight, and an acrylic acid/maleic anhydride copolymer at a level of 2–7% by weight; a chelating agent selected from the group consisting of tetrasodium ethylenediaminetetraacetate at a level of 1–8% by weight, ethylenediaminetetraacetic acid at a level of 1–8% by weight, and mixtures thereof; and a mixture of C9-11 Pareth 8 at a level of 1–10% by weight, C6–12 Pareth 6 at a level of 0.5–5% by weight, and PEG Cocomonium Chloride at a level of 1–10% by weight, to a surface of the printing equipment bearing an ink residue;

(b) allowing the formulation to combine with the ink residue;

(c) removing the combined formulation from the surface; and (d) repeating steps (a) through (c) as needed until the surface is substantially clear of the ink residue.

2. The method as set forth in claim 1, further comprising before step (d) the step of subjecting the surface of the printing equipment to mechanical agitation.

* * * * *